United States Patent [19]

Crout et al.

[11] Patent Number: 4,693,101

[45] Date of Patent: Sep. 15, 1987

[54] ADAPTIVE, SELF-REGULATING FORGING HAMMER CONTROL METHOD

[75] Inventors: Charles J. Crout; Charles W. Frame, both of Chambersburg; Ronald N. Harris, Ft. Loudon, all of Pa.

[73] Assignee: Chambersburg Engineering Company, Chambersburg, Pa.

[21] Appl. No.: 576

[22] Filed: Jan. 5, 1987

Related U.S. Application Data

[62] Division of Ser. No. 695,697, Jan. 28, 1985, Pat. No. 4,653,300.

[51] Int. Cl.[4] ..... B21J 7/38; B21J 7/40

[52] U.S. Cl. ..... 72/20; 72/8; 72/11; 72/21; 72/438; 364/472; 91/40; 100/269 R

[58] Field of Search ..... 72/19, 20, 21, 6, 8, 72/9, 11, 13, 15, 438; 364/476, 472; 173/5, 8, 19, 21; 91/40, 39, 165, 248, 275; 100/48, 269 R

[56] References Cited

U.S. PATENT DOCUMENTS

| | | | |
|---|---|---|---|
| 3,142,206 | 7/1964 | Hague et al. | 72/15 |
| 3,464,315 | 9/1969 | Weyer | 72/20 |
| 3,818,799 | 6/1974 | Hague | 72/20 |
| 3,916,499 | 11/1975 | Frame et al. | 100/48 |
| 3,930,248 | 12/1975 | Keller | 340/261 |
| 4,116,122 | 9/1978 | Linder et al. | 72/19 |
| 4,131,164 | 12/1978 | Hague et al. | 72/21 |

FOREIGN PATENT DOCUMENTS

| | | | |
|---|---|---|---|
| 94800 | 7/1980 | Japan | 72/21 |
| 703362 | 12/1979 | U.S.S.R. | 72/11 |
| 915990 | 1/1980 | U.S.S.R. | 72/11 |
| 893279 | 12/1981 | U.S.S.R. | 72/9 |

*Primary Examiner*—Robert L. Spruill
*Assistant Examiner*—David B. Jones
*Attorney, Agent, or Firm*—Dann, Dorfman, Herrell and Skillman

[57] ABSTRACT

A die forging hammer senses the pressure of striking air and the pressure of lifting air from within the cylinder as well as ram start position. Various empirical information is stored and available to a computer which uses the inputs to compute velocity ram position, rebound velocity and other pieces of information. In order to use the lifting air data, sequential pressure measurements are made by a microprocessor and stored for analysis and for use in deriving from stored empirical information about machine characteristics ram velocity and related information. Three types of systems are interwoven and may be used separately or simultaneously to control the blow control system. Different programs are employed, preferably using algorithms applicable to the equipment in processes to derive desired output or intermediate information.

4 Claims, 20 Drawing Figures

(FIG. 12)

ADAPTIVE, SELF-REGULATING FORGING HAMMER CONTROL METHOD

This is a divisional application of Ser. No. 695,697 filed Jan. 28, 1985 now U.S. Pat. No. 4,653,300.

The present invention relates to a forging hammer system that enables the kinetic energy of a ram at impact to be a selected predetermined amount, which may or may not be quantified to the user. The system includes components and controls of the system which enable the system to be both adaptive and self-regulating. Various parameters are sensed in this system in order to modify the level of energy imparted by a ram at impact. In its preferred form, the system includes means to enable related parameters to be sensed. If the magnitude of these sensed parameters or derived parameters deviate from a predefined normal level, corrective means is applied.

BACKGROUND OF THE INVENTION

The present invention grows out of a continuing development of forging hammer controls. In recent years, forging hammers have increasingly been of the compressible fluid driven type. A device disclosed in U.S. Pat. No. 4,131,164, the invention of Wilmer W. Hague and Charles W. Frame, senses position of the ram, and hence the piston, to make sure that the piston position does not partially occlude the intake port when the inlet valve is opened in order to assure repeatable performance. The impact device of U.S. Pat. No. 3,464,315, the invention of Henry A. Weyer, provides pilot valves to control inlet and exhaust valves. U.S. Pat. No. 3,818,799, the invention of Wilmer W. Hague, allows both the number and intensity of the series of blows to be performed by a forging hammer to be preselected. Each of these patents is assigned to the assignee of the present invention, Chambersburg Engineering Company.

These prior art refinements represent important steps along the road to automation and efficiency. However, these developments were accomplished by knowing what the forging device was capable of doing and assuming that it would always perform in precisely the same way, or making correction based upon a single parameter to allow the forging device to perform that way. While this assumption resulted in important improvements over the prior art, the assumption was a generalized one and often subject to error. In fact, many factors enter into the operation of the forging hammer which cause the energy of blows intended to be identical, to vary from one another, depending upon variations in operating parameters.

The advent of computer assisted die design, which prescribes discrete magnitudes of forging energy, demands that forging equipment be capable of delivering precise energies per blow. Developments of this sort have made greater precision in energy control in a forging operation of great significance. The present invention is in response to this need.

SUMMARY OF THE INVENTION

The present invention relates to a system for a forging hammer which has been adapted to be capable of sensing parameters related to the kinetic energy of the ram at impact. The system of the present invention is capable of responding to changes or corrections made in the course of its operation as a result of the continual sensing of the parameters. The result is that the product which is forged may be made better because of control of energy with greater precision. The amount of energy consumed is reduced because it is carefully monitored and controlled to provide just the correct amount.

In the prior art, the tendency has been to use more energy than required to be sure that there is sufficient to do the forging job. In fact, the excess energy employed in the prior art has taken its toll in wear and destruction of dies and in the fatiguing of parts of the hammer at a more rapid rate than occurs when energy is controlled to be more nearly what is needed, as in accordance with the present invention. Moreover, by being able to sense and control, not only is energy saved but, in some cases, time may be saved since a piece may be finished without an extra stroke. If used with automatic feed and other automatic features, this can mean that more product can be made using less energy in a shorter time.

It will be appreciated by those skilled in the art that the forging hammer of the present invention employs a relatively short stroke compared, for example, with free-falling drop hammers or even various types of steam-driven devices. The device employed is ordinarily one which is fluid driven. Ordinarily a piston is driven from the side opposite the ram by admission of air under a pressure to the region of the cylinder above the piston. It should be understood, however, that the present invention is also applicable to forging devices which operate in horizontal orientation, including particularly those employing two opposed rams. Such a device is described, for example, in U.S. Pat. No. 3,916,499. In employing such a device, each of the rams would employ a system similar to that employed by the single ram, in the system to be hereafter described.

More specifically, the present invention relates to an adaptive, self-regulating forging hammer control system employing an impact device having a frame supporting at least one cylinder. A piston is employed within that cylinder and means connecting said piston to a ram whereby the ram may be repeatedly movable relative to the frame from retracted position to impact position. A driving fluid system is employed including a fluid supply. Valve means connects said fluid supply into the cylinder at a position within the cylinder to drive said ram into impact and provides exhaust from the at least one cylinder. Valve control means permits automatic adjustment of the valve means. A retracting fluid supply is connected to the cylinder in position to return the ram to retracted position. Sensing means sense selected parameters related to kinetic energy and provide signals representative thereof. Input means enables selection of desired kinetic energy levels for successive blows. Computer means receives the signals from the sensing means and also receives input selection of the desired kinetic energy level for a specific blow and generates an output to the valve control means to adjust valve means to produce the desired kinetic energy. In preferred embodiments, adjustment to the valve means adjusts valve timing to produce the desired kinetic energy. Preferably, at least position of the piston at the time of fluid admission and pressure of the lifting fluid are sensed. Other parameters such as a pressure of the fluid driving medium at the inlet and velocity of the ram at the top of the stroke improve accuracy.

The present invention also contemplates a method of obtaining adaptive blows of preselected kinetic energy in an impact device. By that method, various parameters related to kinetic energy are sensed. For example, position of the piston at the time of fluid admission is sensed, and pressure of the lifting fluid is preferably sensed. Pressure of the inlet fluid, and velocity of the ram at the top of the stroke position, are other parameters that may be sensed. The sensed parameters are correlated in connection with predetermined criteria to determine a possible range of kinetic energy of the ram at impact. The correlation is next compared with kinetic energy demand at an input. Adjustment is then made of the fluid flow in order to produce the desired magnitude of kinetic energy at the time of ram impact. Adjustment may be made by timing inlet of fluid at the top of the cylinder and the exhaust of that air.

The present invention also provides other adaptive techniques which allow corrective adjustment of the energy blow to be delivered, as well as self-regulating techniques which allow correction when it appears that error due to other than sensed factors is creeping into effective energy delivered at the ram.

For a better understanding of the present invention, reference is made to the accompanying drawings in which.

Figures 5, 7:
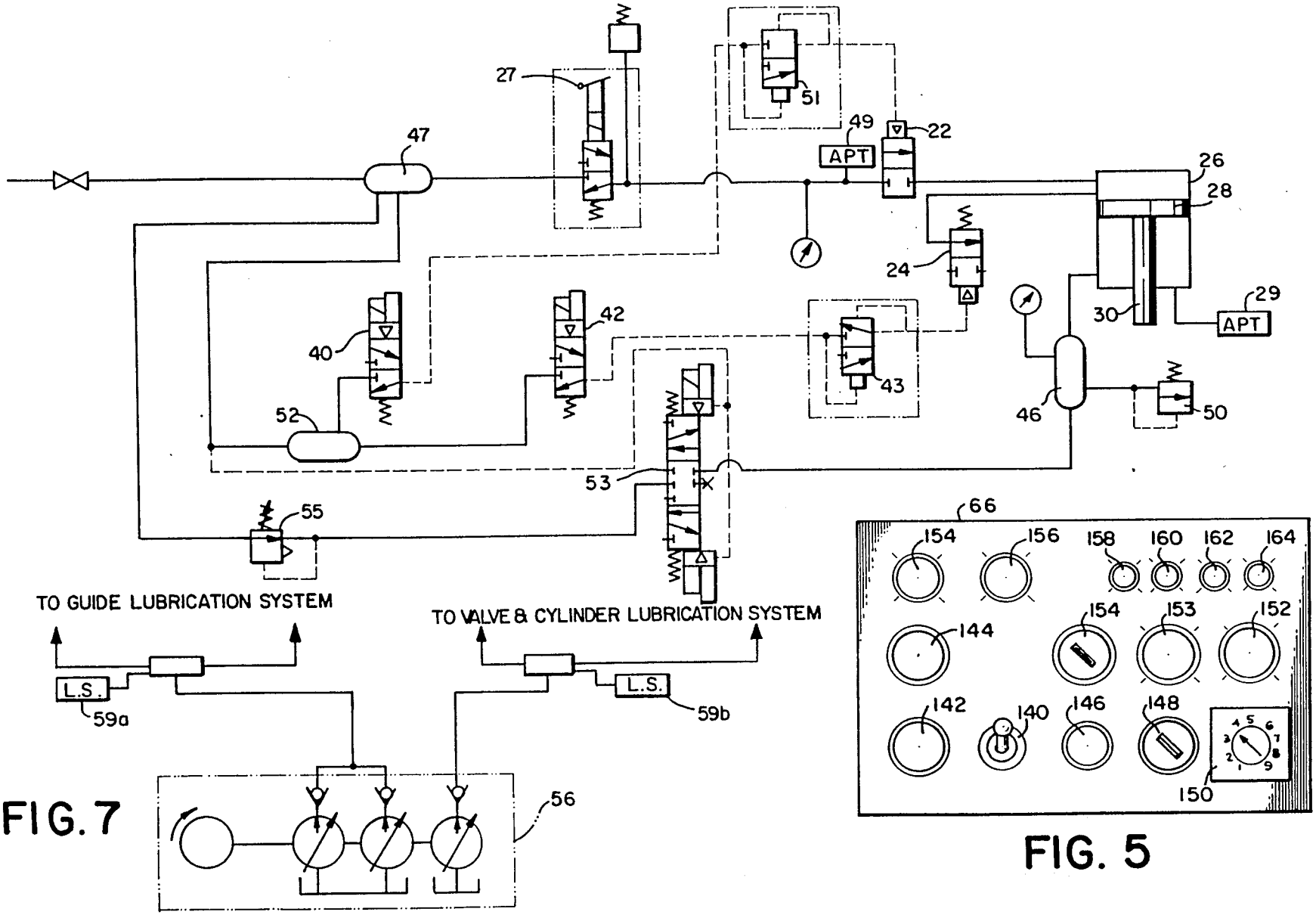
FIG. 5 is an enlarged view looking down on the operator's control station panel.
Figure 6:
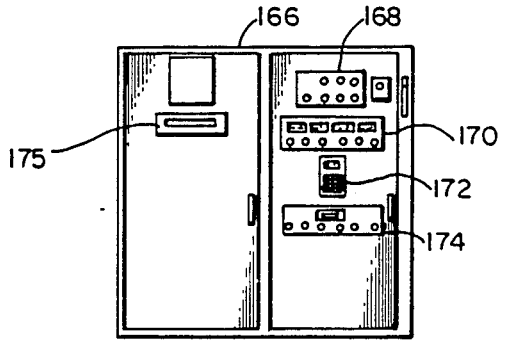
FIG. 6 is a very much reduced scale drawing of the controls cabinet of the present invention.
Figure 6A:
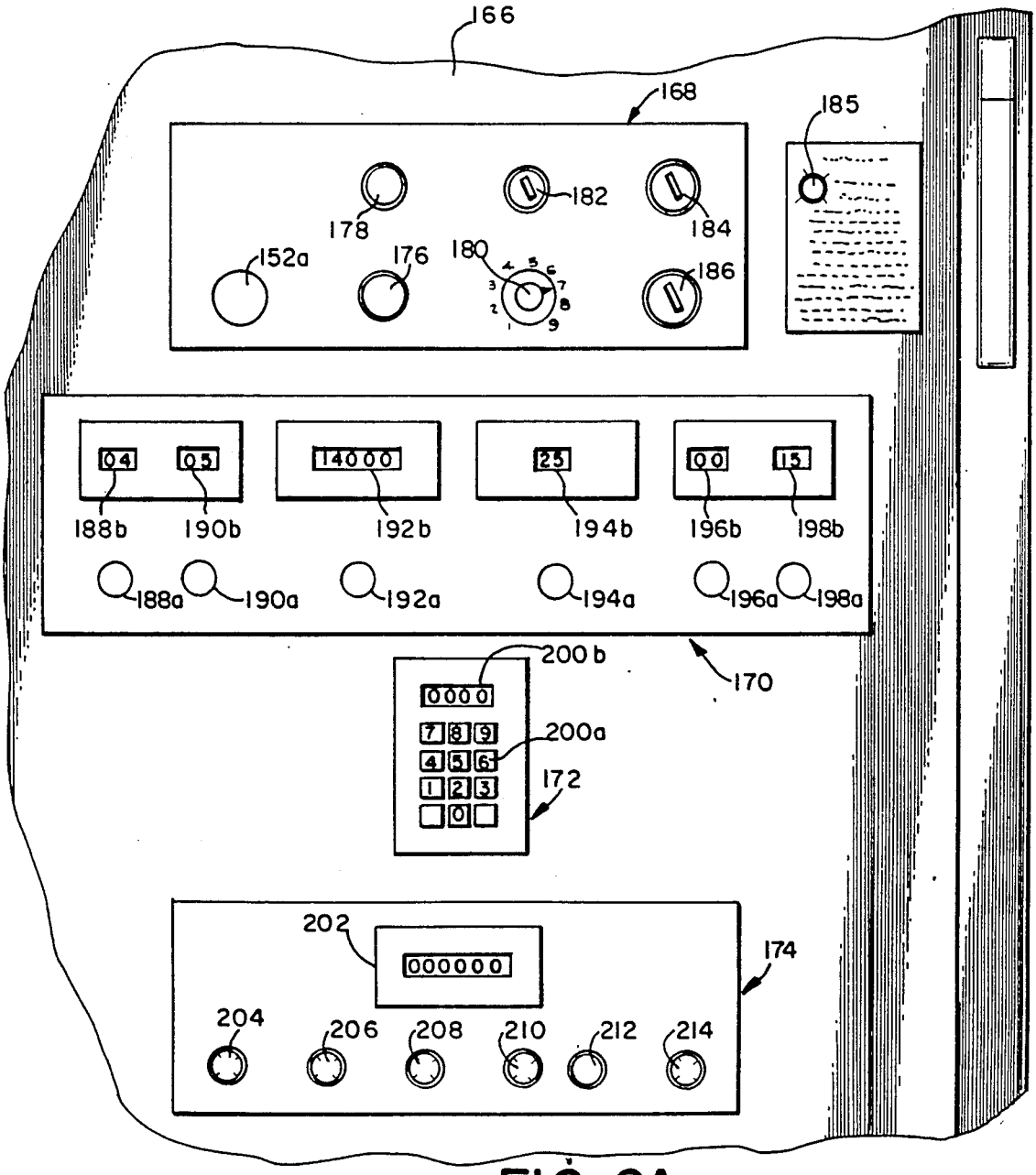
Figure 8A:
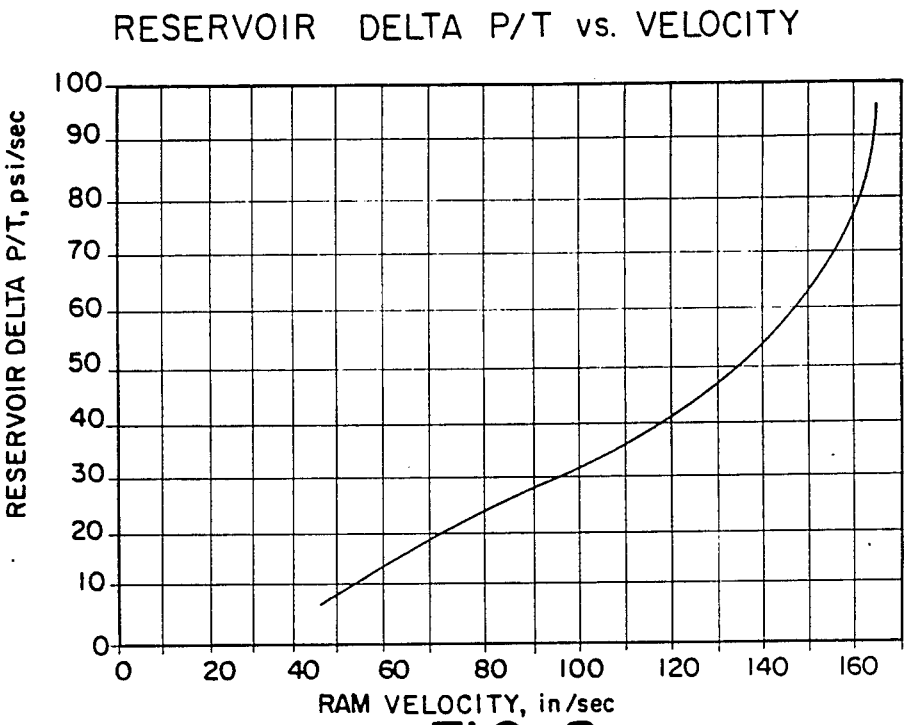
Figure 8B:
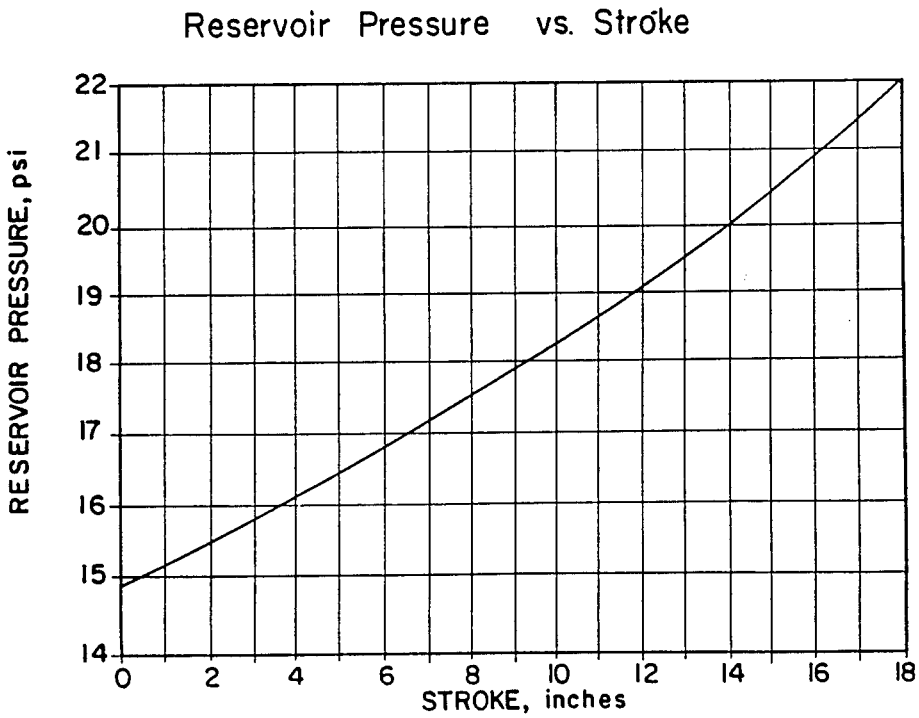
Figure 9A:
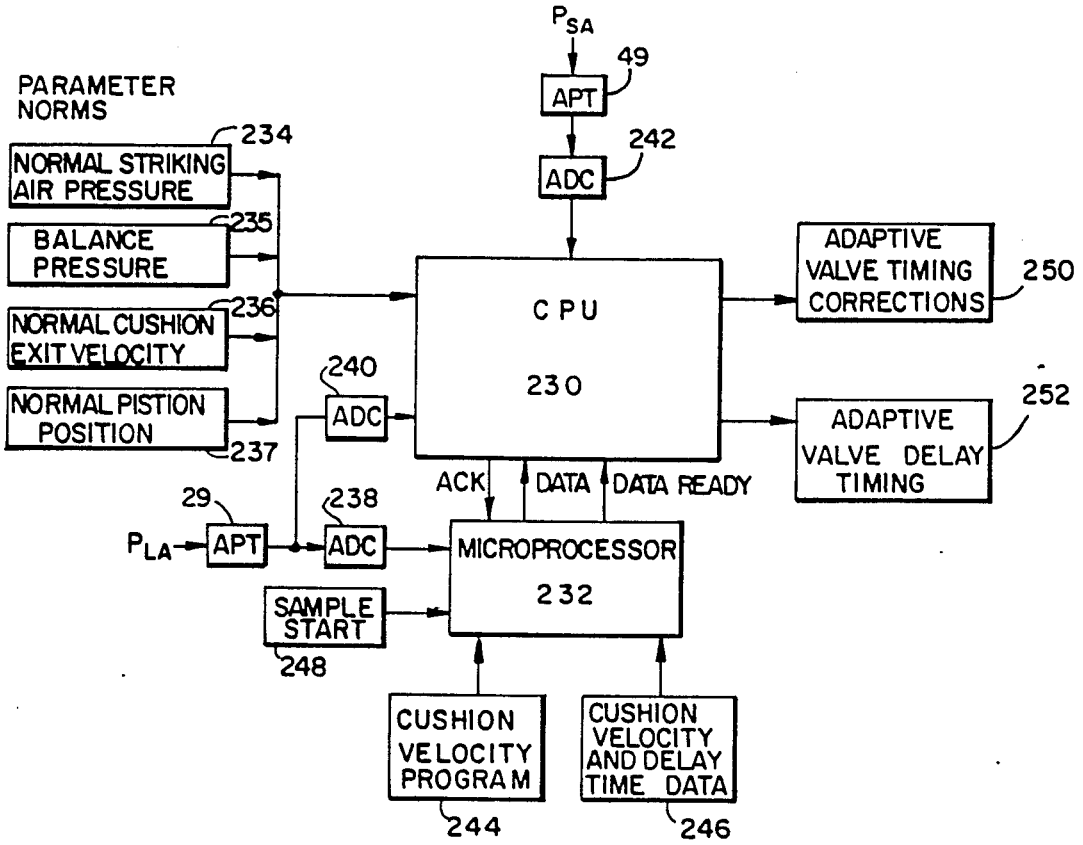
Figure 9B:
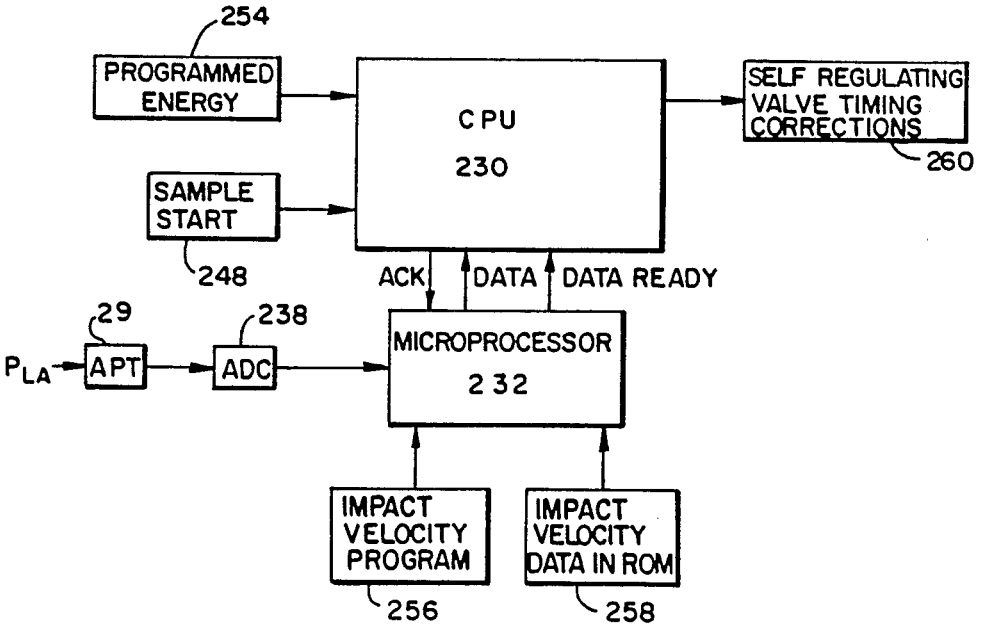
Figure 9C:
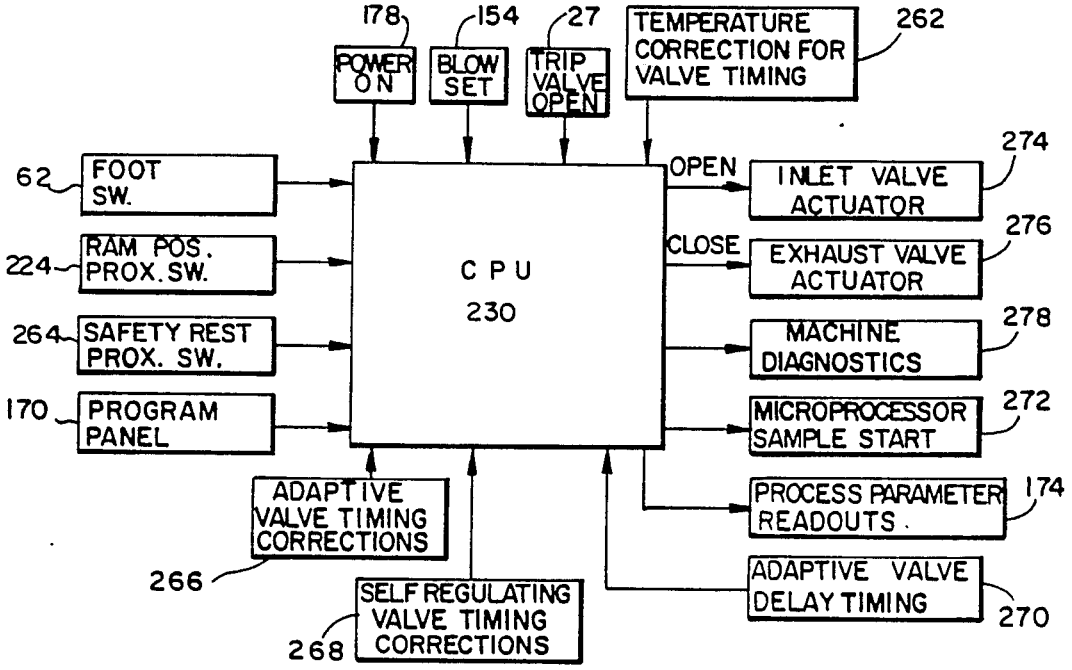
Figure 9D:
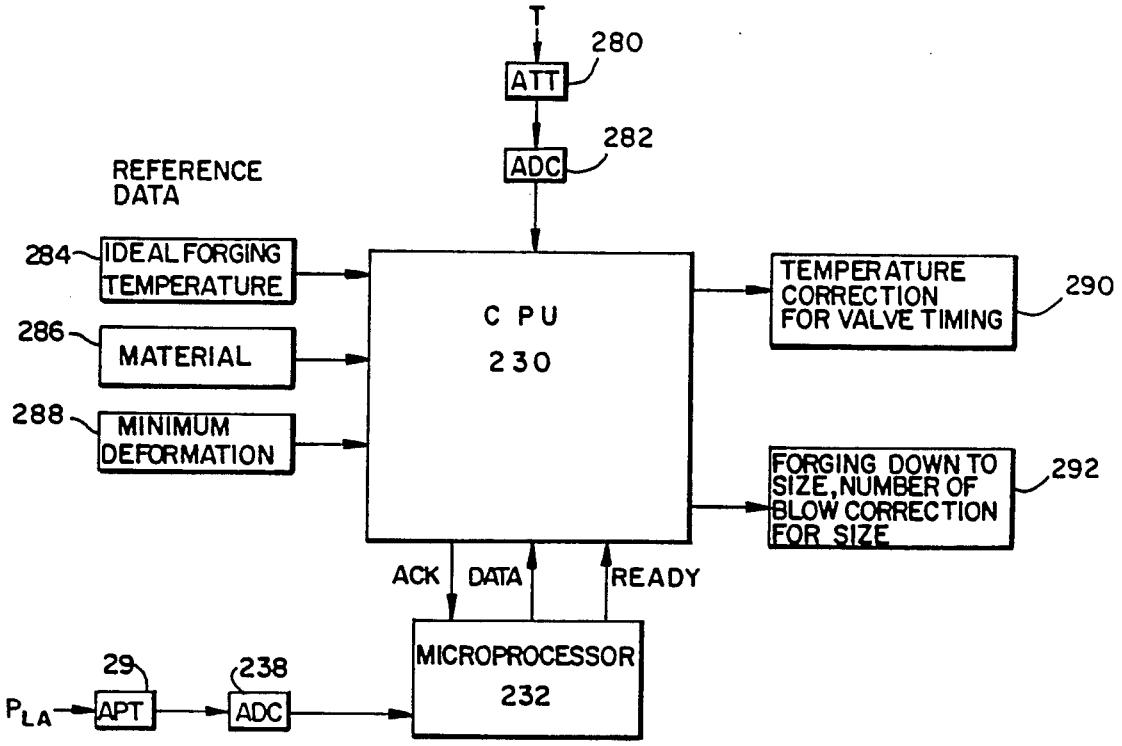

FIG. 6*a* is an enlarged view of the program selection panel on the controls cabinet of FIG. 6;

FIG. 7 is a schematic fluid system diagram of the controls for the forging hammer and components shown in the previous drawings;

FIG. 8*a* is a graph plotting the ratio of change in reservoir pressure, in pounds per square inch, over time, in seconds, against ram velocity;

FIG. 8*b* is a graph of stroke, in inches, versus reservoir pressure, in pounds per square inch;

FIG. 9*a* is a block diagram schematically showing an adaptive control system for a forging hammer in accordance with the invention;

FIG. 9*b* is a block diagram schematically showing a self-regulating system for a forging hammer in accordance with the invention;

FIG. 9*c* is a block diagram schematically showing a blow control system, which may receive inputs from the other systems, in accordance with the present invention;

FIG. 9*d* is a block diagram showing in combination various types of process adaptive control systems in accordance with the present invention.

Figure 10:
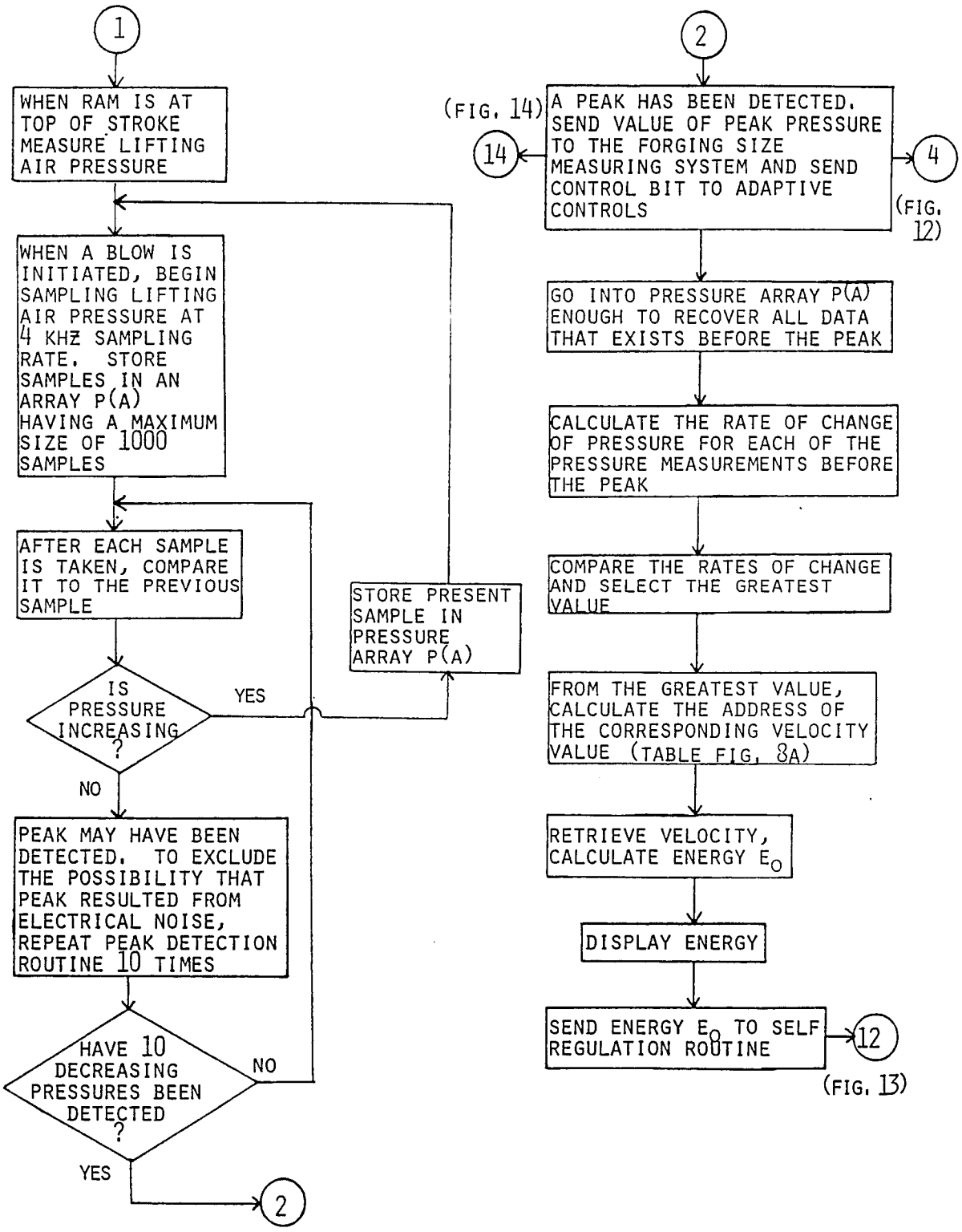
Figure 11:
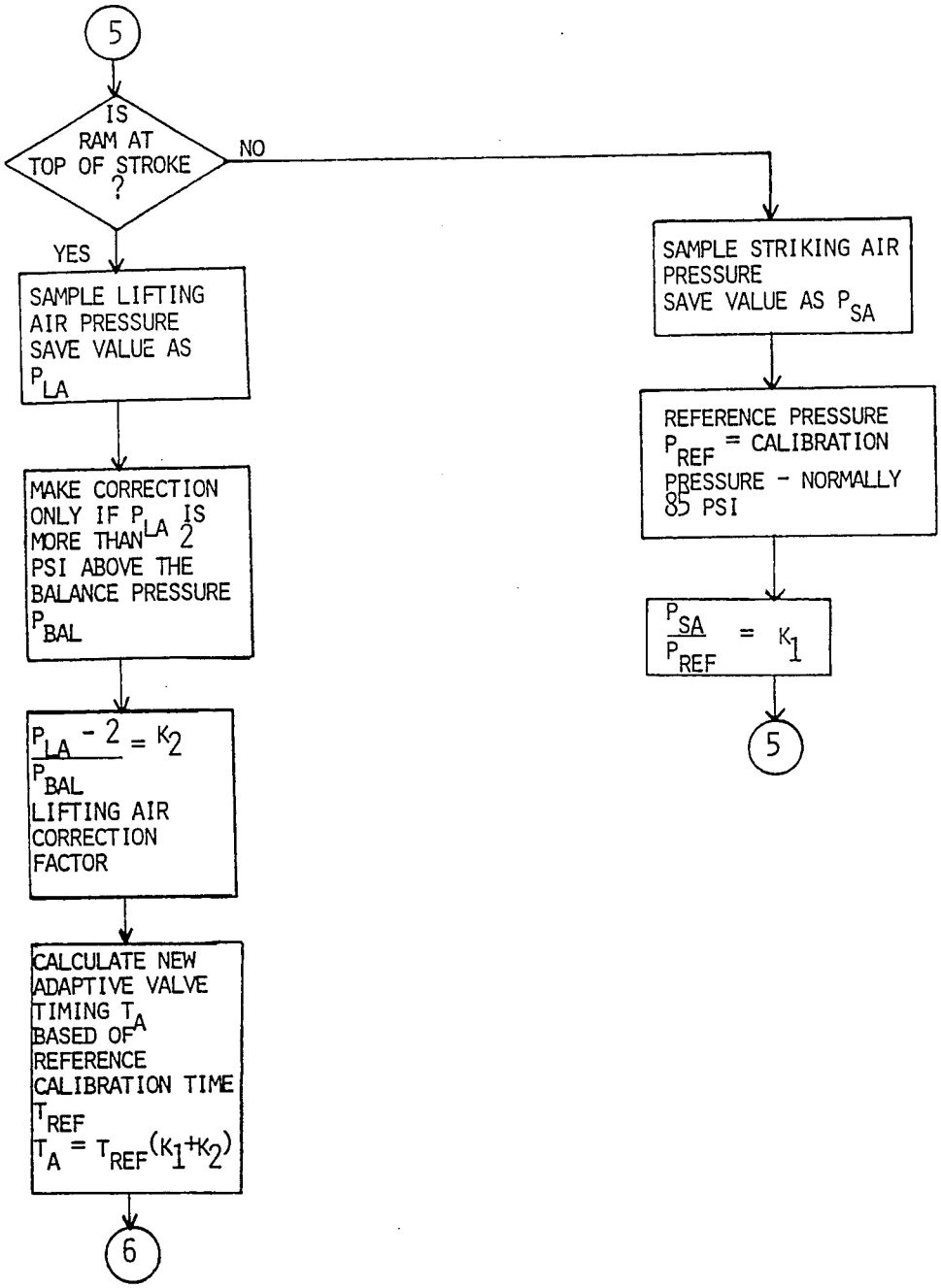
Figure 12:
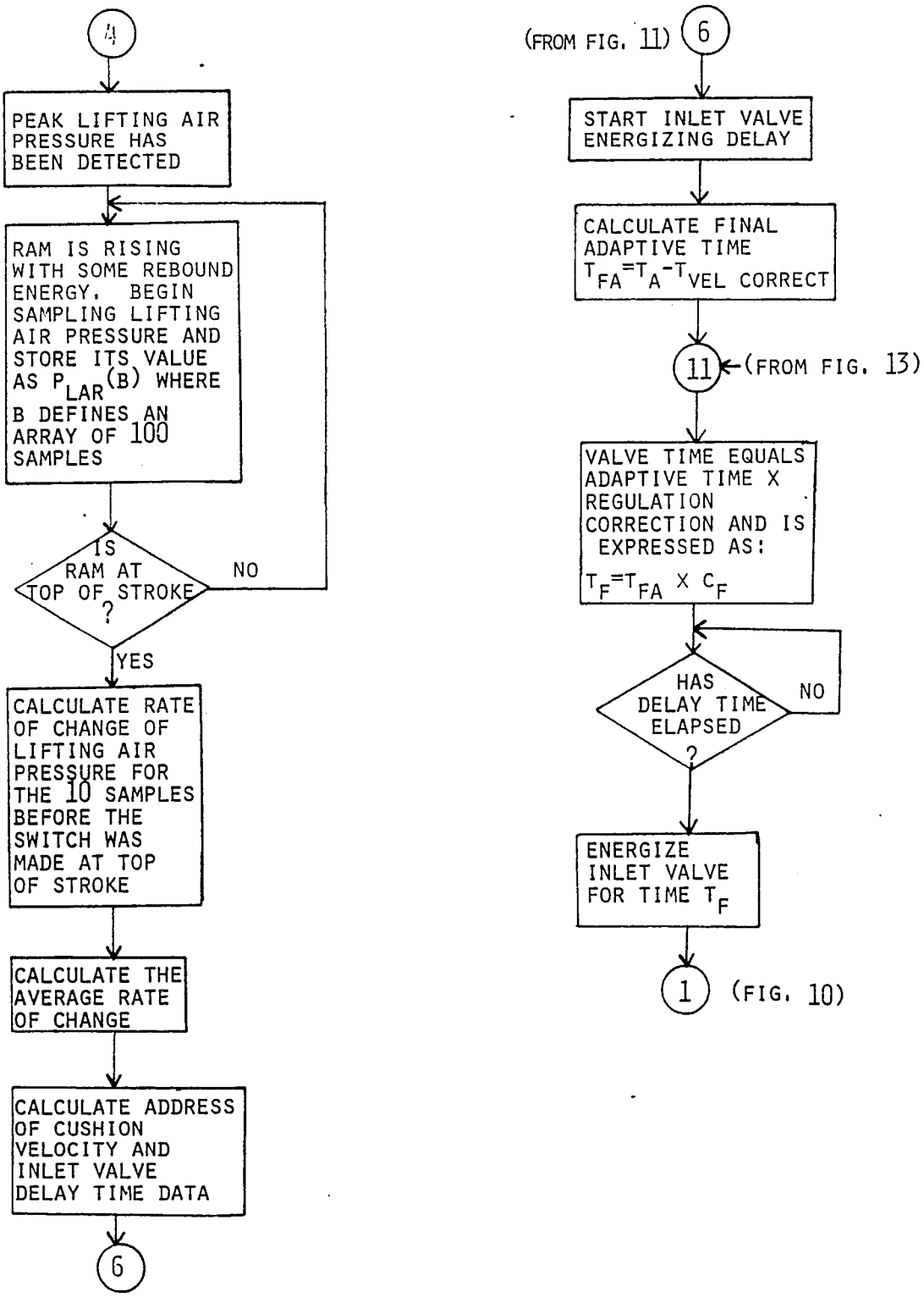
Figure 13:
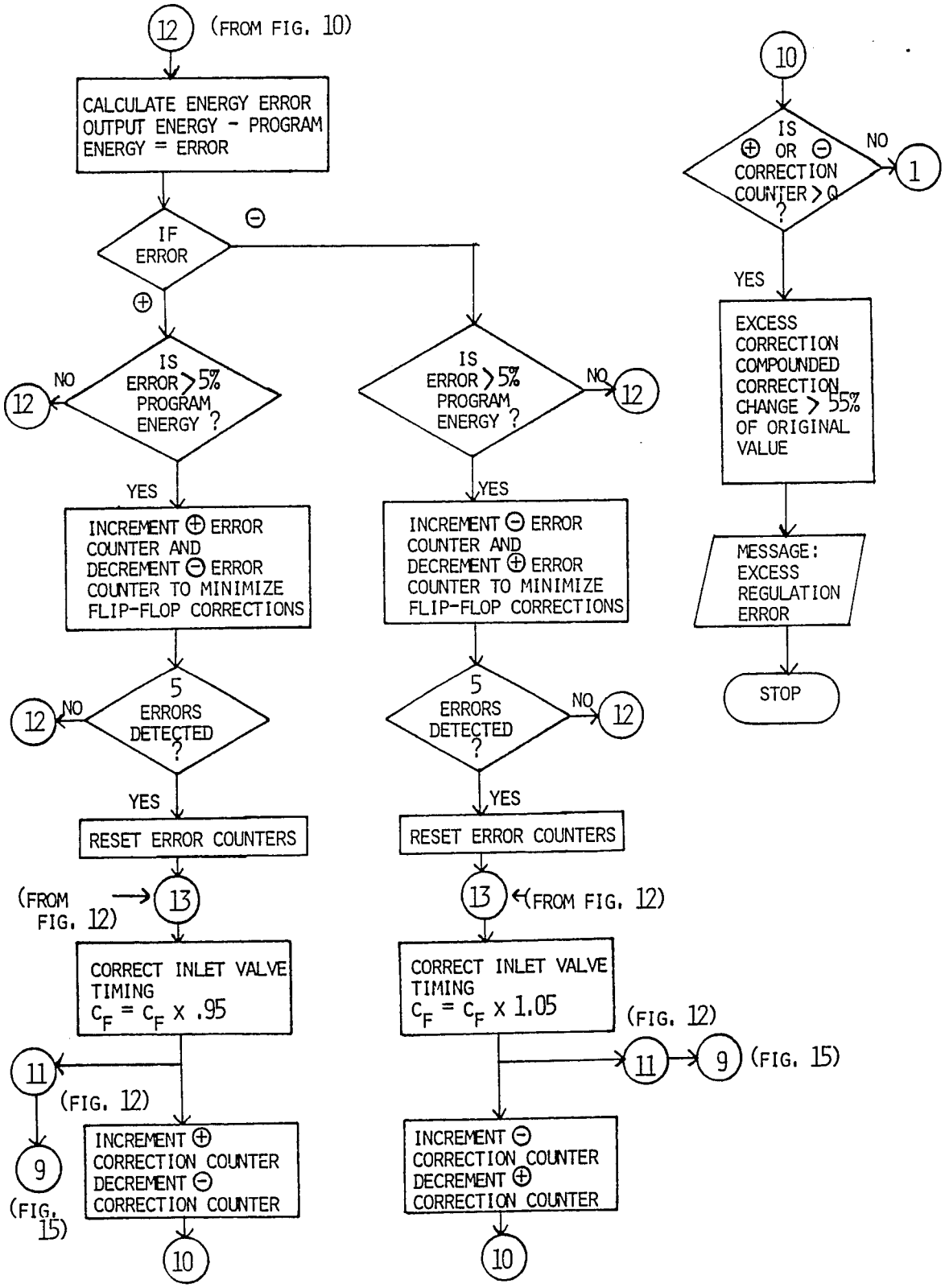
Figure 14:
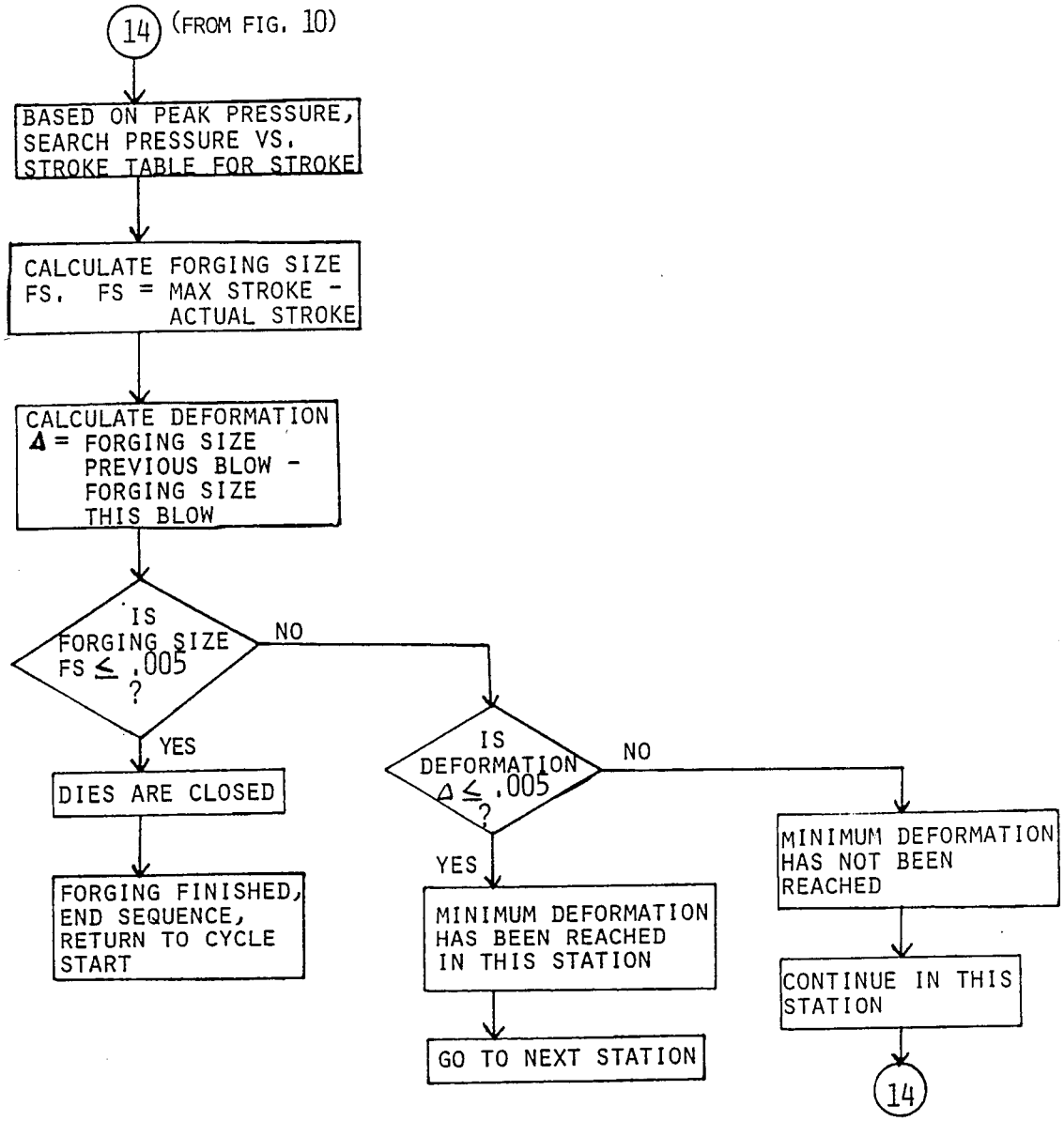
Figure 15:
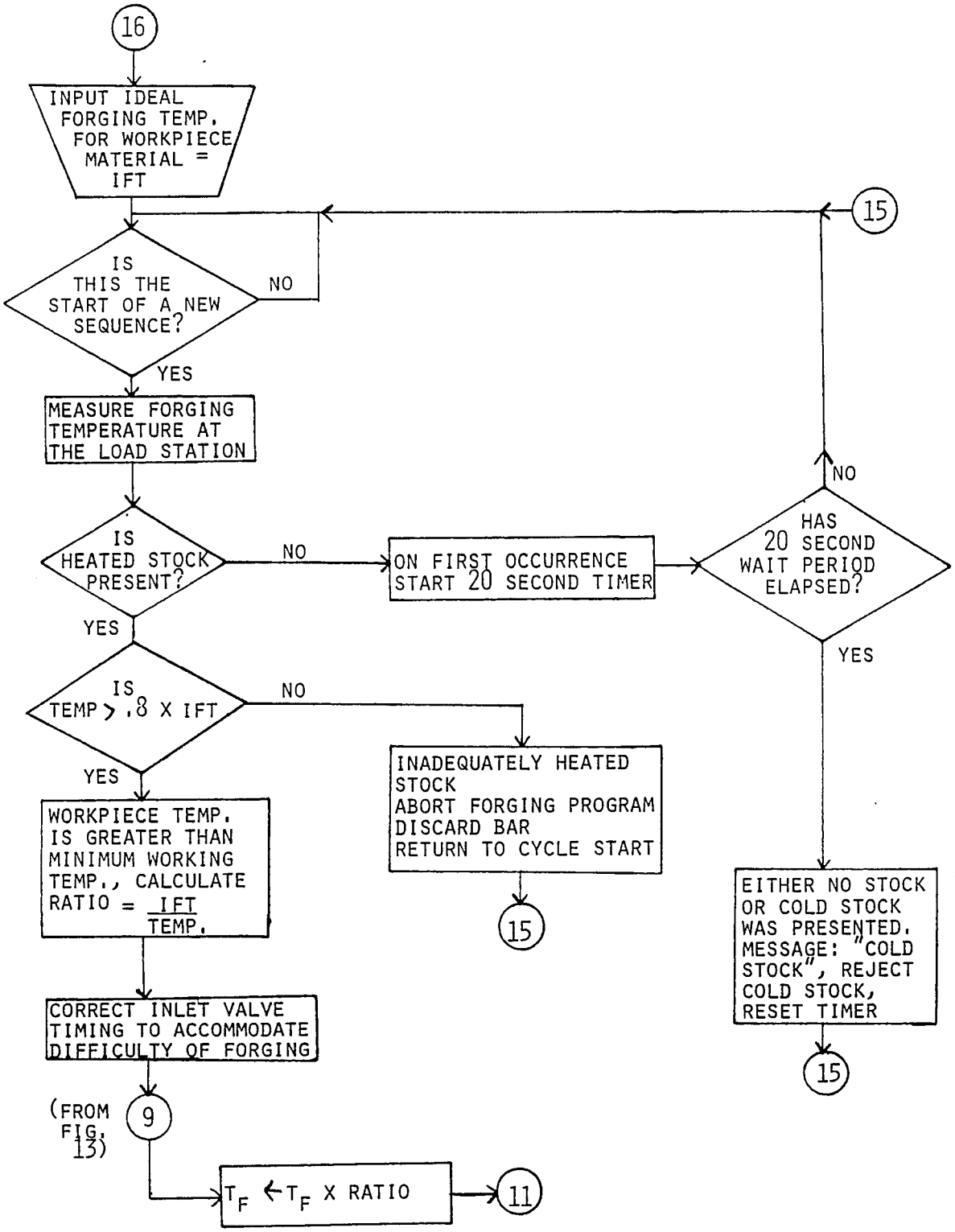

FIG. 10 is a flow diagram showing an algorithm for impact velocity measurement;

FIG. 11 is a flow diagram showing an algorithm for the adaptive controls;

FIG. 12 is a flow diagram showing more of the algorithm for the adaptive controls;

FIG. 13 is a flow diagram showing an algorithm for self-regulating controls;

FIG. 14 is a flow diagram showing an algorithm for a forging size measuring system; and FIG. 15 is a flow diagram showing an algorithm for energy regulation based on forging temperature.

Figure 1:
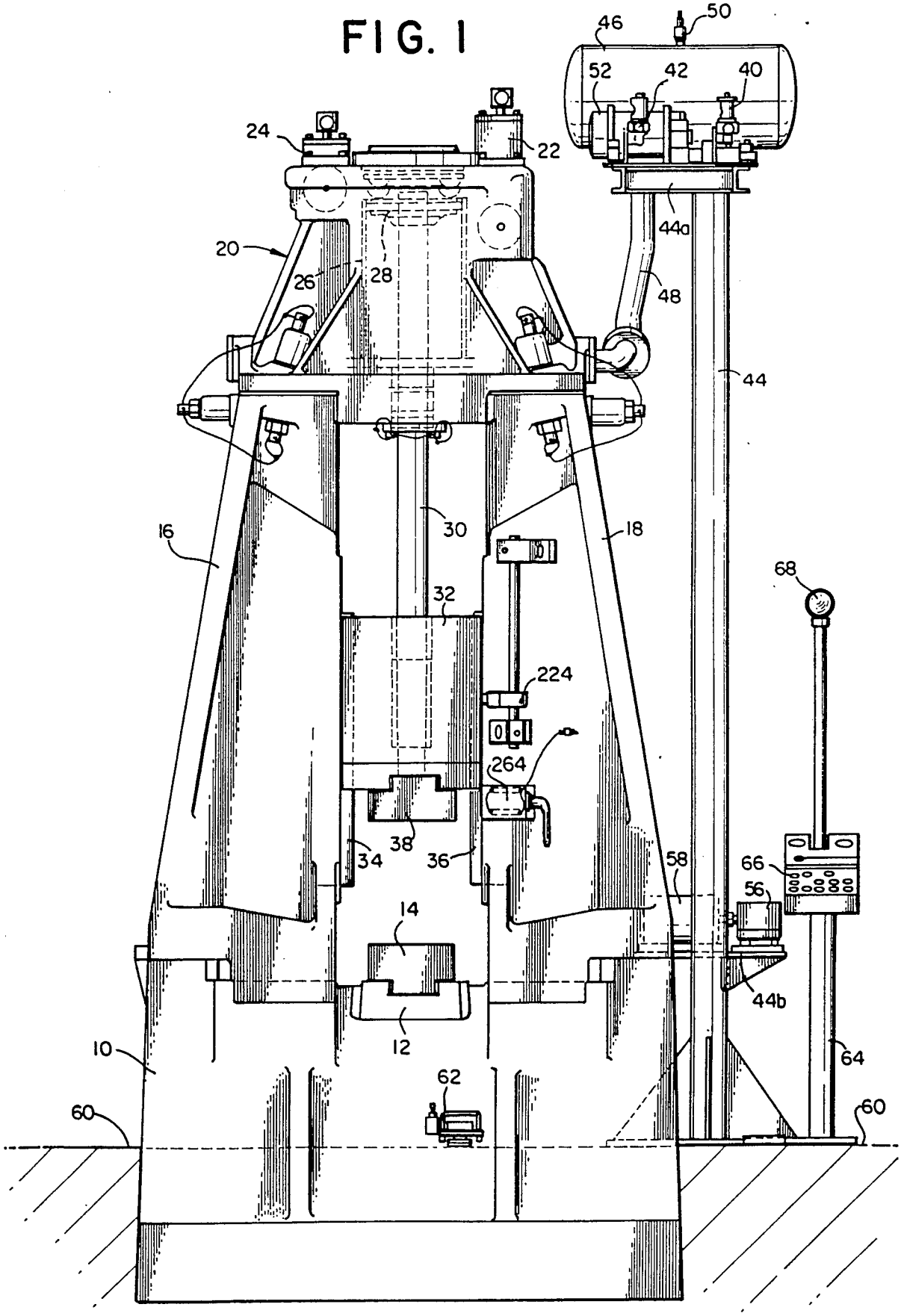
FIG. 1 is a front elevational view of a forging hammer employing features of the present invention.

Referring first to FIG. 1, the forging hammer shown employs an anvil 10 of generally conventional form. Anvil 10 supports an anvil cap 12, which, in turn, supports and positions an anvil die 14. Supported on the anvil 10 are a pair of similar, but mirror image frame members 16 and 18. The frame members, in turn, support at their top a main cylinder assembly 20 which houses the control valving for the cylinder. Air under high pressure for operating the cylinder is introduced through main inlet valve 22 and exhausted through the main exhaust valve 24. Within the assembly 20 is a main cylinder 26 (shown in phantom in FIG. 1) which is connected with the valves 22 and 24 near its top in order to drive the piston head 28 down in cylinder 26 and permit its return. piston head 28 is connected to and drives piston rod 30 and ram 32 supported at its bottom. Ram 32 is guided at its edges by ram guides 34 and 36 on frame members 16 and 18. The ram 32, in turn, supports a ram die 38 in opposition to anvil die 14 and positioned to cooperate with the anvil die in forging operations to forge an object of shape determined by the cooperating dies.

Main inlet valve 22 is a specially designed, straightway, two position, normally closed inlet valve designed to admit air into the cylinder 26. Main exhaust valve 24 is a specially designed straightway, two position, normally open exhaust valve designed to exhaust air from the cylinder 26. The volume of the cylinder 26 under the piston is in constant communication with a source 46 of low pressure air, called "lifting air", through line 48. The lifting air serves to retract the piston when air is exhausted through the main exhaust valve 24 and hold the piston at the top of the stroke position to provide standard positioning for entrance of air through inlet valve 22 to drive the piston downward. It should be noted that lifting air reservoir 46 can be made integral with, independent of and cooperating with cylinder assembly 20, thus eliminating connection 48.

Figure 2:
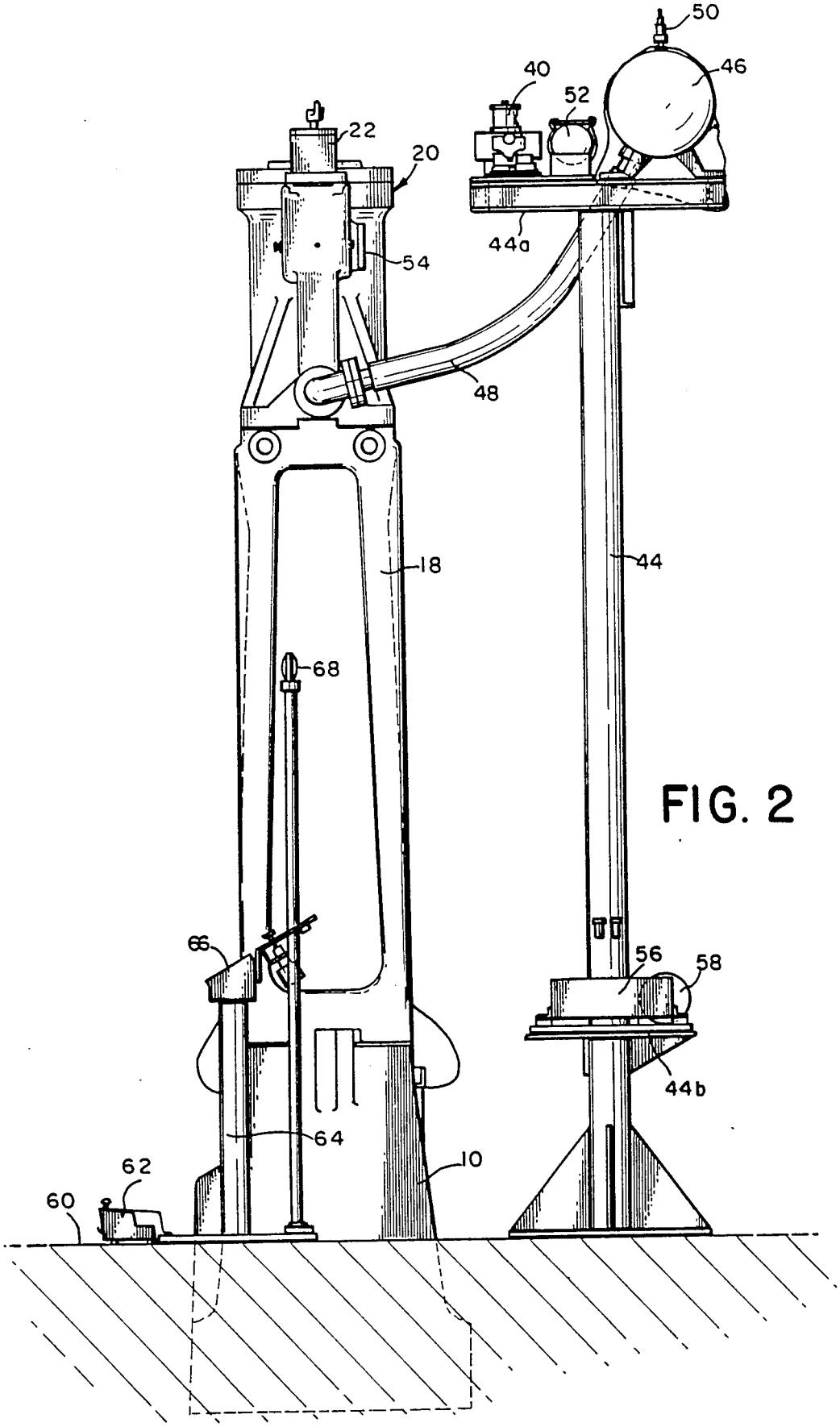
FIG. 2 is a side elevational view of the forging hammer of FIG. 1.

Cooperating with the main inlet valve 22 is an inlet pilot valve 40. Cooperating with the main exhaust valve 24 is an exhaust pilot valve 42. These valves are supported on a platform 44*a* at the top of an accessory stand 44. As seen in FIG. 2, also supported on the platform is the lifting air receiver tank 46 which is connected by a line 48 to the bottom of cylinder 26. Lifting air receiver tank 46 is provided with a safety pop-off valve 50. Also supported on the platform 44*a* is the control air receiver 52 for air which operates pilot valves. High pressure striking air is introduced into an inlet port 54 through a duct (not shown) into the main inlet valve 22. Supported on a lower platform 44*b* of accessory stand 44 is a motor driven lubricator 56 driven by motor 58.

As is indicated schematically in FIG. 1, the anvil is placed in the ground 60 below grade, indicated by the cross hatching. The accessory stand 44 is supported at ground level and its base fixed to the ground. A foot switch 62, by which the forging hammer may be actuated, also rests on the ground but is connected to the system by sufficient length of flexible cable to permit moving to positions convenient for various jobs. Also supported on the ground is a stand 64 which supports an operator control station 66, to be described hereafter, and a flashing safety light 68.

Figure 3:
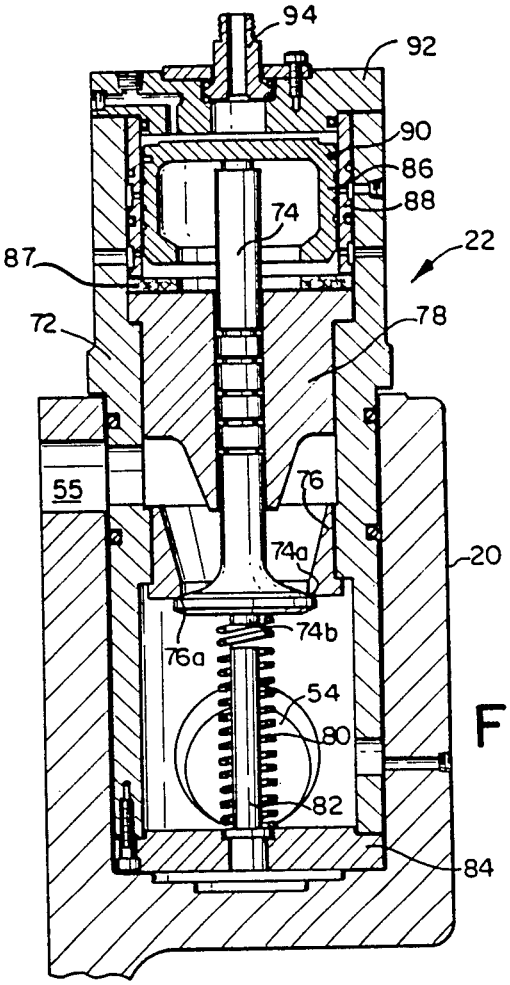
FIG. 3 is an enlarged sectional view of the main inlet valve seen in FIGS. 1 and 2.

FIG. 3 is an enlarged view of inlet valve 22 seen in FIGS. 1 and 2. This sectional view shows that the inlet valve housed in removable body 72 is designed to be inserted into place within the main cylinder body 20. In so inserting the valve, the air intake port 54 in the cylinder must be lined up with a similar port in the valve body and an outlet conduit 55 must be lined up with the cylinder port. O-rings or suitable sealing means are provided to minimize escape of air between the removable body and the cylinder body. The valve is a straightway, normally closed, valve. A poppet valve 74 having a seat 74*a* is arranged to cooperate with annular seat 76*a* on a seat ring 76 within the valve body. Valve guide 78 aligns the valve with the seat and assures proper registration. The valve is normally held in closed position by helical spring 80, which is properly located by retainer 82 press fitted into cap 84 which closes the valve body 72. The end of spring 80, which bears against valve 74 and tends to urge it into closed position, surrounds guide stub 74*b* to help keep the spring in proper position. A plunger 86 at the top of the stem drives valve 74 into open position as pilot air is introduced above the plunger. Plunger 86 moves with respect to bushing 88 held in place within the body 72. A sealing ring 90 limits escape of air around the plunger. The valve body is closed by a cap 92 through which a resilient mounted fitting 94 is provided to permit connection with a source of pressurized air to drive the plunger 86 downward against the pressure spring 80 and against the air pressure acting on the head of valve 74 and open the valve. When the pressure is removed, the valve will be returned to closed position by spring 80 and air pressure on valve 74. As the plunger is driven downward, it impacts an elastomeric pad 87 which absorbs the energy released upon arresting the motion of the plunger.

Figure 4:
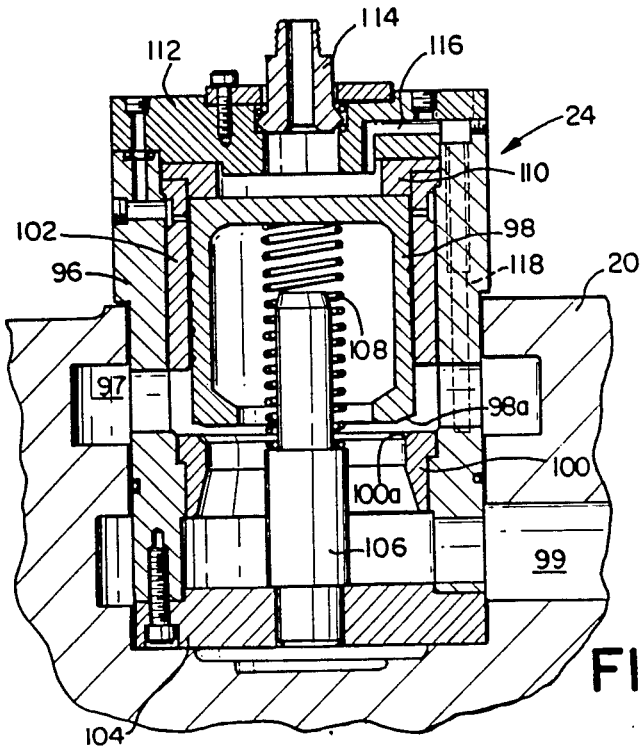
FIG. 4 is an enlarged sectional view of the exhaust valve seen in FIG. 1.

Referring now to FIG. 4, the main exhaust valve 24 is illustrated. The exhaust valve is also a unitized assembly and can be installed or removed from the main cylinder body 20 as a unit. Generally cylindrical body 96 is designed to fit within the cylinder structure and be aligned so that its inlet port is aligned with the exhaust duct 99 from the cylinder 26 and its outlet port aligns with the duct 97 to the exhaust system. The valve 98 is provided with a seat 98*a* which is mutually ground with seat 100*a* of seat ring 100 fixed to the body 96. The valve guide 102 aligns the valve 98 with the seat 100. The valve is normally held in open position by helical spring 108 which is properly positioned by retainer 106 press fitted into the cover 104 closing one end of body 96. An elastomeric stop 110 serves as a shock absorber when arresting the return motion of the valve to open position under the urging of spring 108. The valve is actuated closed by the action of control air admitted through resiliently mounted fitting 114 in end cap 112. Removal of control air allows the valve to return to the open position, exhausting air through fitting 114. Heater 118 is provided in this exhaust valve since the expansion of the gases tends to cool the valve parts to the point where frost might otherwise accumulate. By preventing frost accumulation, the heater prevents possibility of malfunction.

The control panel 66 is seen in an enlarged view in FIG. 5. The panel contains various controls and various indicators to allow an operator to safely control the hammer. On the panel is a manual inching control for the ram, joystick switch 140. The joystick is arranged so that, when directed upwardly, the ram slowly goes up and, when directed downwardly, the ram slowly goes down. A no blow safety pushbutton 142 is provided to de-energize the safety trip valve 27 (FIG. 7) and the controls. A blow set pushbutton 144 powers the controls and allows the trip valve to be opened. Inching active illuminated pushbutton 146 allows the ram to be slowly raised when the pushbutton 146 is illuminated and depressed at the same time that joystick 140 is directed upwardly.

Lubricator prime/run selector switch 148 when set to "prime" causes the lubricator 56 to be on all the time, but when set to "run" allows the program to control when the lubricator is on. Calibrated dial control 150 selects blow energy during manual operation. When the system is in manual mode, manual mode light 152 will be on. When the lubricator motor 58 is energized, lubricator light 153 will be on. Fault alert light 154 signals the operator to check the alpha numeric display for a fault message. Cycle start light 156 signals the operator that the controls are set and ready for starting a new forging. Blow switch light 158 is illuminated when the ram is at the top of its stroke, ready to make a blow. Safety rest light 160 signifys that safety rest is retracted. Inlet valve light 162 is illuminated while the inlet valve 22 is opened. Exhaust valve light 164 is illuminated while the exhaust valve is closed. Inlet valve override selector switch 154 is a key operated override for inlet and exhaust valves used for driving the rod 30 into the ram 32 during assembly.

FIG. 6 shows in a small inset drawing a cabinet structure 166 which is much reduced in size from the actual structure. On one side of the cabinet are provided controls. Panel 168 provides manual operators enabling set up and monitoring of the system. Panel 170 is the programming and display panel. Panel 172 is a numeric program input key pad. Panel 174 is a parameter monitoring panel.

Referring to FIG. 6*a*, an enlarged view of the panels, is illustrated. In the manual set-up panel, pushbutton 152*a* is a no blow safety pushbutton, the function of which is to de-energize the trip valve quickly to prevent operation as needed. Power off pushbutton 176 de-energizes the panel and ram inching controls. Power on illuminated pushbutton 178 powers the panel and ram inching controls. Dial 180 is a sequence controller which may be set for one to nine sequences for a program. Key operated selector switch 182 is a program/-run switch whereby the operator may change a forging program and the machine will not run until set to the run position. Key operated selector switch 184 is provided to enable automatic programmable controls to be activated, or alternatively manual back up controls activated. Selector switch 186 activates exhaust valve heaters 118 to prevent the exhaust valve from freezing up. Light 185 monitors a.c. power to the processor, indicating when the processor is on.

Panel 170 provides light emitting diode displays in coordination with pushbuttons used to set up or change a program. For example, pushbutton 188*a* is used to set up or change a program which is indicated on display 188*b*. This program is the sequence number where the desired sequence is input. Pushbutton 190*a* sets the number of blows, and display 190*b* shows the blows selected. Pushbutton 192*a* selects input of the desired energy and display 192*b* shows the energy selected. Pushbutton 194*a* is a ram rebound control; display 194*b* shows the input degree of control. Switch 196*a* is a sequence mode selector, and display 196*b* shows the mode selected. Switch 198*a* selects the time delay between sequences, which is then shown on display 198*b*.

Panel 172 is the input key pad for the program with a typical telephone touch pad orientation of input number switches 200*a* and a display 200*b* showing the numbers selected.

Panel. 174 provides striking air pressure selector 204 and lifting air pressure selector 206, and production rate selector 208. Selector 208 selects the current production rate in number of platters per hour. Selector 210 selects the total production count since last reset. Total production reset switch 212 sets the system to zero, and energy switch 214 monitors the ram impact energy in foot pounds for each blow. The LED display 202 is used to monitor each of the functions as selected by the pushbuttons when the pushbuttons are depressed. In short, it is a display of quantitative selections made by the pushbuttons.

FIG. 7 shows in schematic form a diagram of the controls for the hammer of the present invention. It will be seen that striking air pressure is received in striking air receiver tank 47 and must be passed through a safety trip valve 27 which is electrically energized by pushbutton 144 on the control panel shown in FIG. 5 and actuated manually. An analog pressure transducer 49 is provided in the line to sense the striking air pressure supplied to inlet valve 22. The valve is normally closed as shown, but, when opened, will feed the top of cylinder 26 to drive the piston 28. Lifting air pressure beneath piston 28 is monitored by analog pressure transducer (APT 29). valve 22 is actuated by inlet pilot valve 40 receiving air from the control air receiver 52. When actuated, the pilot valve feeds through the quick exhaust valve 51 to the top of inlet valve 22 to drive the inlet valve into open position and allow the high pressure air to be fed to cylinder 26.

Exhaust valve 24 is normally opened but is closed in coordination with the operation of the inlet valve to enable the cylinder to operate. In order to close the exhaust valve 24, air from the control air receiver 52 is fed through exhaust pilot valve 42 and through a quick exhaust valve 43 into the pilot air chamber of exhaust valve 24, closing the exhaust valve. When the air is removed, the exhaust valve will open. Thus, the quick exhaust valve can function to quickly cut off the supply and terminate the closed nature of the exhaust valve. Just as the quick exhaust valve 51 rapidly cuts off the pilot air to the inlet valve and rapidly terminates the air flow driving the ram.

To recapitulate the operation of the inlet valve, the valve is normally closed and is held closed by action of spring 80 and the striking air acting on the underside of valve 74. When the solenoid operated inlet pilot valve 40 is energized, control air is admitted through the fitting 94 and acts upon the plunger 86 accelerating it downward. This causes the poppet valve 74 to leave the seat 76 and allows striking air to flow through the valve and into the main cylinder. When the inlet pilot valve 40 is deenergized, the control air is exhausted and the poppet valve 74 and plunger 86 are urged toward their normal positions by spring 80. A quick exhaust valve 51 located adjacent to the inlet 94 facilitates exhaust of air from the pilot section of the valve in order to enhance valve response.

The valve operation of the exhaust valve 24 which is normally open and held open by the action of spring 108 is somewhat different. When the solenoid operated exhaust pilot valve 42 is energized control air is admitted through the fitting 114 and acts upon the upper surface of the valve 98 driving it downward so that seat 98*a* engages seat 100*a*. Thus, the flow of exhaust air from cylinder 26 is shut off. When the exhaust pilot valve 42 is de-energized, control air is exhausted and the valve 98 is urged upward allowing the free flow of exhaust air from the cylinder. Quick exhaust valve 43 located adjacent the fitting 114 facilitates exhaust of air from the pilot section of the valve in order to enhance valve response. Because the air moving through the exhaust valve has recently undergone expansion, its cooling can cause frost to form on valve parts in intimate contact with the cold air. To discourage a build up of frost which tends to inhibit the free flow of exhaust air, electric heating elements 118 have been located within the valve body. These elements can be energized when needed to warm the valve parts and prevent frost accumulation. A lifting air pressure regulator 55 operates through a solenoid operated lifting air control valve 53 to regulate the lifting air in an effort to maintain the lifting air constant at a fixed pressure to urge the piston 28 to the top of main cylinder 26. The lifting air functions to raise the piston in main cylinder, and a safety pop-off valve 50 is provided to quickly release lifting air should pressure build too high.

Motor driven lubricators 56 feed through lines to guide lubrication systems and to valve and cylinder lubrication systems for typical purposes. Limit switches 59*a* and 59*b* are provided to actuate lights to indicate if the lubrication system oil flows are not maintained so that the system may be shut down and the problem corrected.

FIGS. 8*a* and 8*b* are actual plots involving return air pressure, sometimes known as reservoir pressure. In FIG. 8*a*, the plot is the change in the ratio of pressure in pounds per square inch over time in seconds against ram velocity in inches per second. The plot in FIG. 8*b* is of stroke, or actual ram or piston movement, in inches plotted against reservoir pressure in pounds per square inch. The information plotted in these graphs is determined empirically for different sizes of machines and other input conditions and there may be a family of such plots, which are stored as points or correlated values in look up tables for example in a ROM. Such information is useful in connection with the various algorithms, as will appear hereafter.

Referring now to FIGS. 9*a*, 9*b*, 9*c* and 9*d*, there are shown a series block diagram of separate systems or subsystems, each of which employs the same computer or central processing unit 230 and may also employ an associated microprocessor 232. Each of these systems in effect stands alone except that the blow control system of FIG. 9*c* is fed by the outputs of one or all of the other systems. In each system, various pieces of sensed or computed information are input into the computer directly or indirectly through the microprocessor together with manually selected standards for comparison. The microprocessor is needed in order to store various inputs at sequential times at a rapid rate (e.g., $4KH_z$) to produce a sequence of readings for storage and comparison.

Referring to adaptive control system of FIG. 9*a*, the analog pressure transducers seen in FIG. 7 are used as inputs. Transducer 49 senses the pressure of the striking air $P_{SA}$ applied to the cylinder 26 above the piston 28 and transducer 29 senses the pressure of the lifting air $P_{LA}$ within the cylinder. The striking air pressure sensed by transducer 49 is intended to be constant but may change. The pressure of the lifting air 29 will change as the piston moves downward and compressing the lifting air and upward allowing expansion of the lifting air.

Lifting air pressure sensed by transducer 29 is then fed to digital converters 238 and 240. Converter 238 takes a path through the microcomputer 232 to compute velocity. The ADC 240, on the other hand, leads directly to the CPU 230 and computes pressure. Specifically, the values that are sought are the lifting air pressure $P_{LA}$ magnitude and ram velocity. Ram velocity, and therefore blow energy, of course, is influenced by the exit velocity of the piston 28 as it rebounds from the cushion and is, therefore, subject to cushion air velocity program 244. Ram velocity and blow energy are also influenced by the position of the piston in the cylinder and, therefore, is subject to the delay time data 246, which, in effect, delays opening the inlet valve, as opposed to changing the time of closing the inlet and opening the exhaust. The sequential pressure measurements fed into the microcomputer are chopped into time and sequence related pressure samples.

In addition to the sensed values, parameter norms are fed into the computer as fixed values. Typically, these may include the normal striking air 234, the balance pressure 235, the normal cushion exit velocity 236 and the normal starting piston position 237. The various information fed into the computer is treated to some pertinent degree by the algorithms or the processes described hereafter. The output of the CPU from the adaptive control system usually is adaptive valve timing correction 250, or it can be adaptive valve delay timing 252. In many cases it will be both, as will appear from the program signals below.

The self-regulating system of FIG. 9*b* uses the lifting air pressure $P_{LA}$ to transducer 29 to digital converter 238 to microprocessor 232. Also, it uses the sample start 248 for proper sequence timing. The programmed input in this case is programmed energy 254. If calculated energy which is generated by the computer does not match the input programmed energy during a predetermined number of blows, an adjustment is made. The microprocessor is subject to the impact velocity program 256 and to impact velocity data in ROM 258. Output is a self-regulating valve timing correction 260.

FIG. 9*c* schematically shows a blow control system. The blow control system conceivably could be used on its own but is usually used to receive as input information from any or all of the systems shown in FIGS. 9*a*, 9*b* and 9*d*. Inputs from these other systems are shown as 266, 268 and 270 and corresponds to the outputs of the other respective systems. Many other inputs may need to be employed, and must be available: the foot switch 62, the ram position proximity switch 224, the safety rest proximity switch 264, various inputs from the program panel 170. In addition, power on 178, blow set 154 and trip valve open 27 enabling setting must be input. Additionally, temperature correlation for valve timing 262 is input. Outputs are primarily to control the inlet valve through actuator 274 and the exhaust valve through actuator 276. The output from the CPU can also give machine diagnostic. displays 278, the nature of which will be described below. As an interim output, the computer 230 can give the microprocessor sample start signal 272 and its process parameter readouts 174. These various system features will be generally understood by the block diagram, but examples can be given. For example, the proximity switch 224 produces a pulse or signal, for example, from a flip-flop enabling the CPU 230, once the ram has reached the top of its stroke. The CPU, however, cannot perform its function, and is not fully, activated until the foot pedal 62 is depressed, activating indicator 234. When the CPU 230 is ready, the microprocessor is activated through activating signal means 272 so that signals from the other system 266, 268 and 270 may be fed directly to the CPU 230 or through the microprocessor.

In accordance with one procedure, when the ready signal is fed to microprocessor 232, at the same time, a signal is given to the actuator 274 to open the inlet valve and to the actuator 276 to close the exhaust valve. With this type of program, the variable output from the CPU is in the calculated timing to trigger the actuator 274 to close the inlet valve through actuator 274 and to open the exhaust valve through actuator 276.

In a simple case, the calculated time, which depends only on energy calculated as a result of the sensing of the lifting air pressure, may determine the timing of the system. As a practical matter, in most cases, other factors intervene, as will be apparent hereafter from the various algorithms of FIGS. 10 through 15. These algorithms are dependent upon various process programs which may be accessed by the CPU. For example, a change in the striking air pressure sensed by analog pressure transducer 49 which generates a signal through analog to digital converter 242 may act upon the CPU to show a deviation which is handled by one of the process programs to be later described to make an adjustment in the timing. Other factors, of course, require adjustment in the timing as will be seen. Those factors may be inherent in the ram itself in the simplest cases, but, in more complex cases, may also take into consideration extrinsic situations, which are handled by the system of FIG. 9*d*.

Referring now to FIG. 9*d*, the input into the CPU through the microprocessor 232 is lifting air pressure by way of transducer 29 and an analog to digital converter 238. Temperature T is sensed by a temperature transducer 280 which has its signal digitalized by analog to digital converter 282. In this case the inputs, indicated as reference data, are ideal forging temperature 284, information about the nature of the forging material 286 and minimum deformation 288. Outputs from the CPU 230 may be temperature correlation for valve timing 290, or may be the number of the blow and correction for size in forging down to size at output at 292. Either or both of these outputs may be input into the blow control system of FIG. 9*c*.

Ram position is sensed by the peak lifting air pressure, or other means to sense relative die position, which provides an output signal representative of die spacing or separation and thereby determines how close to completion a particular forging is. When the forging is completed, as shown by the dies closing or impacting, the sequence of blows to that particular billet in that particular station of the die must be terminated. This termination may be shorter than the programmed time. It may be necessary to preempt the program, either to stop the process or to automatically cause a shift in the billet. For example, the billet may be shifted from one station to another station within the die and a new billet fed into the first work station using automatic equipment.

Consideration will now be given to the specific programs or algorithms which are provided in connection with the present invention. It will be understood that these are representative and other types of algorithms and other types of processes by similar or different kinds of algorithms may be employed as well.

The capacity of the hammer to deform material is measured by the level of kinetic energy possessed by the ram just as the dies impact the forging stock. The kinetic energy is directly proportional to the mass of the ram and the square of the ram's velocity ($KE=\frac{1}{2}mv^2$). It is most important, and different from the prior art, that the energy of each separate forging blow be programmable, infinitely variable, precise and repeatable. The main purpose of the adaptive, self-regulating control system of the present invention is to control the impact energy of the forging hammer within limits of precision heretofore unattainable.

The system controls the timing of the opening and closing of the inlet and exhaust valves in order to establish the magnitude of the ram's kinetic energy, and thus the machine's forging effect. Many factors or operating parameters influence the velocity of the ram at impact. The system may monitor the selected ones of these parameters, and adapts the valve timing so that the impact energy of the ram is equal to the kinetic energy required by the selected input. The parameters include: (a) pressure of the inlet air or other driving medium; (b) velocity of the ram as it exits the cushion at the top of stroke position; (c) position of the piston at the time of air admission; and (d) pressure of the lifting air. The last two factors may be used by themselves to make a good approximation. Other factors, or the same factors rested in other terms may also be used as sensed parameters.

In addition, the adaptive control system is monitored by a self-regulating system that compares the output energy with the selected and programmed input energy levels, and when they differ sufficiently a correcting action is initiated. Thus, factors beyond the scope of the adaptive controls can be corrected for even through their exact influence is not known. Some such factors include: guide friction, changes in control valve response, air line obstructions, etc. With this system the controls seek to provide an average output energy that closely approximates the selected input energy demand.

In accordance with the present invention, the algorithms for one purpose generate information needed by and used by other algorithms. This will appear from the interconnection of the various flow charts discussed hereafter.

Impact velocity Measurement

Impact velocity measurement is the essential part of the self-regulating portion of the control system because it provides the data on which other control decisions are based. velocity can be determined in a number of ways. Perhaps the simplest is a system which uses two limit switches placed a known distance apart and measuring the time it takes the moving ram to pass by the two. Such a system builds on technology taught in U.S. Pat. No. 4,131,164. velocity can be easily calculated using such sensors from the formula: velocity=distance/time. Although this system met with limited success, it did have certain drawbacks which caused investigation of a completely novel approach to the problem.

In connection with the present invention, the ram and die are supported by the pressure exerted by a column of air confined within a closed vessel. (The vessel is called a lifting air reservoir.) From thermodynamic laws, as the volume of lifting air is reduced by the downward motion of the drive piston, its pressure will rise in relation to the decrease in volume. The relationship can be expressed in general terms as:

$$P2=P1(V1/V2)^{1.4}$$

where P2 is the final pressure, P1 the initial pressure, and V1 and V2 the initial and final volumes, respectively. The exponent 1.4 is used to describe adiabatic compression of air. From this bit of thermodynamics, it was concluded that P2 could indirectly represent the stroke of the forging hammer. This being the case, the velocity could be derived by simply differentiating the above equation.

Practically speaking, differentiation is difficult to achieve within industrial controls, but it has been possible to determine such information emperically by test at the time of calibration. A control algorithm shown in FIG. 10 has been developed which produces the required information. The scheme uses an analog to digital converter (ADC) 238 (FIG. 9*b*) from which samples are taken at a rate of 4KHz to constantly monitor the lifting air pressure in the closed vessel. As the ram and die are driven downward, the ADC measures the changing pressure and stores its value in memory. It continues doing this until the peak pressure, which occurs at impact, is detected and positively identified. The controls then analyze the pressure and convert that value to velocity. The relationship between velocity and rate of change of pressure is shown on the attached graph, FIG. 8a. The flow chart presented in FIG. 10 shows the steps taken in derivin9 the velocity and subsequent data.

Once the velocity is known, it then is simple to calculate the energy at impact. Kinetic energy is calculated from the formula:

$$\text{Energy}=\tfrac{1}{2}mv^2,$$

where m is mass and v is velocity. The mass can be derived from the initial pressure (P1) provided by the ADC as long as the area of the drive piston supporting the falling weight (ram weight+die weight) is known. The controls can then solve the above equation for energy which will be used elsewhere in the system algorithm (see FIG. 13).

Adaptive Controls

Adaptive controls are defined as those control elements which monitor external influences affecting the forging hammer's performance and apply corrections, principally to valve timing, before each blow is initiated. These adaptive controls use analog pressure transducers (APT) 49 and 29 to sense the main air supply pressure and the lifting air pressure, respectively. A typical hammer is calibrated at the factory for operation at 85 psi for the striking air supply. The control algorithm, the steps of which are shown in FIG. 11, uses an APT 49 to measure the striking air pressure $P_{SA}$. If the measured air pressure ($P_{SA}$) is different than the calibrated air pressure ($P_{REF}$), the algorithm generates a correction signal proportional to the ratio ($K_1$) of the pressure which is used to correct the valve timing to account for the difference. For example, if the measured air pressure is 93 psi, the algorithm will generate a ratio which will then be used to decrease the valve timing in direct portion to the air pressure ratio to compensate for the greater power available from the higher pressure air source. The correction is designed to work within the limits of 80 and 110 psi since these are believed to be within the limits of actual user facilities. Air pressures outside this . range will produce a fault message from the diagnostic algorithm, described below, and will limit corrections to those that would be applied at one of the two pressure limits.

The adaptive control algorithm of FIG. 11 will also compensate for variations in lifting air pressure $P_{LA}$ measured at the top of the ram/piston stroke. For example, if lifting air pressure rises more than a predetermined amount for whatever reason, the algorithm will generate a correction signal causing the controls to adapt by increasing the valve timing. This correction is needed because the higher lifting air pressure presents more resistance to downward piston movement. Excessive lifting air pressure will be indicated by the fault diagnostics described below.

Also included in the adaptive controls is an algorithm shown in FIG. 12 that recognizes that synchronizing piston with air admission into the drive cylinder is essential to consistent hammer performance when the hammer operates over a wide range of forging conditions. It is essential to admit the air to the cylinder when the piston is in the proper location that position which the piston assumes prior to the first blow of a forging sequence.

When forging work is being done, the impact energy is absorbed by the forging to varying degrees and the ram rebounds off the die and rises to the top of the stroke at a rate proportional to the rebound. Upon reaching the top of the stroke, the piston enters a pneumatic cushion which arrests the ram's upward motion and reverses its direction. The cushion is defined as the area of the cylinder between the exhaust valve port and the cylinder cover. The time that the piston is resident in the cushion is dependent upon the velocity with which it entered the cushion. If air is to be admitted to the cylinder at the precise instant that the piston reaches the exhaust port on its exit from the cushion, then the controls must be able to anticipate when this will occur. In other words, if cushion entrance velocity is high, the time in residence will be short and the controls must adjust blow initiation time to allow for this. In addition, since very little of the ram's kinetic energy upon entering the cushion is lost, the ram will possess nearly the same energy when exiting the cushion. This residual energy will add to the applied energy and therefore can result in impact blows with intensities greater than those set on the controls.

To overcome these observed behaviors, the control algorithm was developed using the same velocity technique shown in the algorithm of FIG. 10 as described above for impact velocity, but looking at the decreasing rate of change of lifting air pressure $P_{LA}$ as the ram rebounds off the die. The algorithm provides that:

1. blow initiation timing depends on cushion entrance velocity. Therefore, for high cushion entrance velocities, a very small time delay will be employed before inlet valve is opened to initiate the next blow. For low cushion entrance velocities, a relatively long delay will be employed. The delay is designed to provide that air will be admitted to the cylinder at the precise instant that the piston is in the optimum position relative to the exhaust port. Thus, the control offers a velocity dependent, infinitely variable time delay for blow initiation on each forging blow;

2. Since the cushion entrance velocity is known, the valve timing can be altered to compensate for the initial energy possessed by the ram as the piston exits the cushion. The correction applied will reduce the inlet valve open time in proportion to the initial velocity thereby adapting for its effect on output energy.

Self-Regulation

Self-regulation is defined as a means by which the hammer controls are able to correct programmed energy data when that data is found to be consistently in error over a prescribed period of time. The flow chart of FIG. 13 illustrates the flow of the algorithm for self-regulation. The concept of self-regulation was developed to eliminate the need for manual program adjustments to compensate for parameter variations that could not otherwise be accounted for or corrected. The concept of self-regulation applies to the control of impact energy by adjusting inlet valve timing to achieve the desired impact energy. To prevent excessive correction or wild correction swings, the controls are designed to accumulate errors, either above or below the set point. When a preset number of errors, all in the same direction, for example 5, is reached, a discreet correction will be applied to the valve timing and the error count will be reset. If errors persist in the same direction, another discreet correction will be made when the preset number of errors is detected. Corrections will continue in this way until a satisfactory level of performance is achieved. In this way, the controls recalibrate themselves to maintain the valve timing and corresponding energy output within the "factory specifications" at all times. In cases where persistent corrections are required in the same direction, the algorithm allows changes only up to 55% of the original value. At that point, it is concludes that something is effecting energy that cannot be corrected for and the machine is shut down with an accompanying fault message appearing on the diagnostic display.

Regulation for Forging Size and Temperature

Regulation for forging size and temperature are features of the self-regulating process control scheme. FIG. 14 shows the algorithm for a self-regulation process for forging size. FIG. 15 shows the algorithm for a self-regulating process for temperature. Self-regulating process controls differ from the previously discussed self-regulating controls in that they take into account those parameters of the process which are not related to machine performance and over which the machine's controls have no direct influence. Two such parameters are forging workpiece size at the conclusion of a blow or sequence and workpiece temperature at the start of forging.

Forging size measuring system is a part of the self-regulating process control system which allows the size of the forging to be determined on each forging blow. The system depends on the same ADC 238 as the velocity system and uses some of the same data to measure the stroke of the ram from the air pressure in the lifting air reservoir. The graph shown in FIG. 8*b* shows the relationship of pressure versus stroke. Using this data and knowing the closed die height, which defines the proper size of finished forging, the forging size is determined by comparing the dynamically developed pressure for maximum stroke and translating them into linear dimension. This dimensional information can then be used to (1) display the deformation of each blow and/or (2) to automatically control the sequencing of the program whenever the forging reaches minimum deformation limits in a station or to terminate the forging program whenever the forging is down to size. The flow chart of FIG. 14 illustrates the steps involved in a preferred process.

Regulation for forging temperature is a second feature of the self-regulating process control scheme. It is a well known fact that the temperature of a forging billet has a tremendous influence upon the ability to deform that billet. At a given temperature, a unit of energy applied to the billet will produce a predictable amount of deformation. As long as temperature and energy remain constant, each successive forging billet will be deformed equally. If, however, temperature decreases and energy remains the same, the deformation will decrease and the forging will be oversized. Conceivably, the temperature could be too high and completion of the forging proceed at a more rapid rate. Therefore, the controls allow the input of actual forging temperature via an ADC 282 from a temperature measuring instrument 280. This input is compared to the reference temperature for the material being forged. If it is higher or lower than the reference, the valve timing can be adjusted up or down to provide consistent working of the forging. The flow chart shown in FIG. 15 illustrates this concept based on the assumption that the measurement is made at the forging load station. Ideally, the measurement should be made at each die impression so that as the forging is worked between the dies and heat transfer takes place, corrections can be made to the inlet valve timing. This ideal situation will have an almost identical flow chart, therefore the simpler case serves well for explanation purposes.

Self Diagnostic Programs and Display

Many of the programs described above allow the controls to determine when error conditions occur within the machine or in the process of which the forging hammer is a part. These and many other conditions which may be sensed directly and displayed on the display panel as a condition or as a cue for action on the part of the operator. They also allow for instructing the operator in proper operation of the hammer and in helping him correct any errors he may have made when operating the machine.

The alphanumeric panel 175 of the controls. The messages may contain both alphabetic and numeric characters. The messages will appear as long as the key operated manual/automatic selector is directed to automatic and the power on pushbutton has been depressed. The following list of diagnostic features, their function, and conditions under which they will exist is a list of more usual features employed:

"Automatic ready" is a prompt message indicating that the controls are set for automatic and that no faults or reasons for delaying have been detected. It may allow the operator to start a sequence or may start the sequence automatically in the absence of a precluding message.

"Battery low" is a warning message which indicates that the battery backing up the memory of the PC has reached a charge level that requires that it be replaced. The message can be generated by an output bit from the PC.

"Trip valve closed" will appear as a message whenever the foot switch is depressed but the trip valve has not been opened. This condition will be sensed by the striking air monitor pressure switch PS1.

A message, "striking air high", will appear whenever the striking air exceeds 110 psi. Pressure transducer PT2 provides this signal. A fault must be present for 15 seconds before the forging sequence can be interrupted. If the fault clears within the 15 second time period, the timer will reset. If the 15 second time expires before the end of a sequence, the interruption will be delayed until the sequence has been completed.

"Striking air low" will appear whenever the striking air pressure drops below 80 psi. Pressure transducer PT2 provides this signal. A fault must be present for 15 seconds before the forging sequence can be interrupted. If the fault clears within the 15 second time period, the timer will reset. If the 15 second time expires before the end of a sequence, the interruption will be delayed until the sequence has been completed.

If striking air pressure varies more than +6 psi between blows when measured with the ram at the top of the stroke, a message, "striking air varying" will appear.

Two identical pressure transducers are preferably provided to measure the lifting air pressure. By comparing the two a comparative calibration can be obtained. If the two transducers differ by more than 2% the message, "lifting sensor fault", will be displayed. The check can be made at the beginning of each forging sequence. The system can be made to interrupt automatically at such signal.

Similarly, two identical pressure transducers are preferably provided to measure the striking air pressure. By comparing the two a comparative calibration can be obtained. If the two transducers differ by more than 2% the message, "striking air fault", will be displayed. The check can be made at the beginnig of each forging sequence. Again interruption of the program may be provided.

If lifting air pressure is more than 2 psi grater than the balance pressure when the ram is at the top of the stroke at the beginning of a forging sequence, the message, "lift air high", will appear. This signal is provided by the lifting air pressure transducer.

If the lubricator motor starter is energized and neither of the lube cycle switches are actuated within a two minute period, the fault message, "lubricator fault", will be displayed and the machine will be shut down at the completion of the forging program.

If only the valve and cylinder cycle monitor switch, LS2, fails to be actuated within 90 second when the lubricator starter is energized, the message, "V-C lub fault", will appear. The machine will shut down at the conclusion of the forging program.

If the guide lube cycle monitor switch, LS1, fails to be actuated within 45 seconds when the lubricator starter is energized, the message, "guide lube fault", will appear. The machine will shut down at the conclusion of the forging program.

If a blow is attempted when the safety rest is extended, the message, "safety rest under ram", will advise the operator of his error and act as a corrector prompt.

If the stroke control proximity switch is not actuated when the trip valve is open, the safety rest is retracted, and when the lifting air is equal to or. greater than the balance pressure for more than 30 seconds, the message, "check blow switch", will be displayed so that the fault will be known and may be corrected.

The controls are arranged to compensate for outside influences like air pressure variations which effect machine performance. However, if these mechanisms were to become ineffective due to some undetected cause, a message would appear. It is determined based on a comparison of the input energy and the measured output energy. If the two differ by more than +10% or −15% after five blows, the error would be signalled by a display reading, "energy regulation err". The machine will be shut down at the end of the sequence until the cause of the variation is determined.

If the measured velocity were less than 1.5 feet/-second or greater than 16.5 feet/second, it is very likely that the velocity measuring circuitry was incorrect. In reality, velocity errors may appear intermittently and at random due to noise or other interference. Such random and intermittent occurrences should not cause an error message to appear nor should they cause another fault to be signalled. Therefore, the logic used for this fault will require that the erroneous velocity must occur four times in a row to initiate the fault message, velocity error.

"Power on", will be displayed after the emergency stop pushbutton is depressed, the trip valve closed (PSl open), and before the blow set is energized to indicate to the operator that the hammer is electrically enabled. It will also appear each time that the Power On pushbutton 178 (FIG. 6A) is depressed at the beginning of operations. The very presence of the message indicates that the panel is under power, therefore caution must be exercised when anyone is around the machine.

The message, "blow set on—caution", will alert the operator to the fact that the blow set pushbutton 144 has been pressed and that the blow controls are active. It will remain on the display until the trip valve is opened.

The message, "excess regulation; check instructions", or alternatin9 messa9es of the first two, then the last two words, will appear whenever the self-regulation system continually regulates in one direction and finally reaches a limit beyond which it cannot go. This fault will indicate that the ram has become tight in the guides, the pilot air to the inlet or exhaust valve is inadequate, that the pilot valves are sluggish, or other causes. For this reason, the operator is instructed to call the maintenance department or check the instruction book himself.

Whenever the inlet solenoid valve is energized and the exhaust solenoid valve is not, the message, "improper valve timing", will be displayed. Its purpose is to eliminate wasting air which can result when the two pilot valves are improperly synchronized.

Whenever the pressure difference between the lifting air regulator and the lifting air reservoir is greater than 6 psi, the message, "excess ring leakage", will appear. Measurements will be made when the ram has been at the top of the stroke for at least 30 seconds. The leakage will be a gradually changing quantity, therefore more frequent measurements are not required.

Optimally, the exhaust valve will control rebound conditions so that the peak cushion pressure is kept within reason. If, however, the rebound is so great that the cushion pressure is greater than 100 psi, then the forging program will halt immediately and the message, "excess lifting speed", will be displayed. This is a safety measure to prevent hitting the cylinder cover.

In connection with display, a "prompt" message is displayed to help the operator better control the machine or correct an error that he may have made. A message indicating a fault is normally accompanied by a flashing red indicating light 154 at the operator's control panel 66 in FIG. 5. The flashing light 154 is intended to call the operator's attention to the message appearing at the main control panel in FIG. 6A. An interrupting fault, normally automatically interrupts the forging sequence at the completion of the current program but could do so immediately in certain circumstances. However, a message is displayed on control panel accompanied by a flashing red indicating light at the operator's control panel. The flashing light is intended to call the operator's attention to the message appearing at the main control panel.

We claim:

1. The method of obtaining a preselected kinetic energy at the time of impact in blows of a ram of a forging hammer ina system employing an impact device having a frame supporting at least one cylinder, a piston within said cylinder, means connecting the piston to a ram such that the ram is repeatedly movable relative to the frame from a retracted position into impact position, a driving fluid system including a fluid supply, value means connecting said fluid supply into said at least one cylinder at a position in the cylinder to drive the ram into impact position and permitting release of fluid from the cylinder, and a source of lifting fluid causing the ram to be retracted from impact position when fluid driving the ram into impact is released from the cylinder, comprising: sensing when the ram and piston are in a predetermined position adjusting the valve means such that fluid flows into the cylinder at a time related to the sensed postion of the ram and piston, determining periodically sensing pressure of the lifting fluid beneath the ram at regular time intervals to determine the rate of change of pressure with respect to time at various such intervals, employing a computer having a memory to determine maximum velocity from rate of change of pressure with respect to time, calculating from the kinetic energy maximum velocity and ram mass.

2. The method of claim 1 wherein the energy calculated is compared with the selected input energy to determine if there is error from the input and if there is error, correction is made by changing the timing of operation of the valve means to reduce or increase accordingly the kinetic energy at impact.

3. The method of claim 1 in which the computer memory includes a look up table device for the rate of change pressure with respect to time against velocity.

4. The method of claim 1 in which the computer memory includes an algorithm that expresses velocity in terms of rate of change of pressure with respect to time.

* * * * *

UNITED STATES PATENT AND TRADEMARK OFFICE

CERTIFICATE OF CORRECTION

PATENT NO. : 4,693,101

DATED : September 15, 1987

INVENTOR(S) : Charles J. Crout, Charles W. Frame and Ronald N. Harris

It is certified that error appears in the above-identified patent and that said Letters Patent is hereby corrected as shown below:

Column 18, line 22, "ina" should read --in a--;

line 27, "value" should read --valve--;

line 37, "postion" should read --position--.

Signed and Sealed this

Twenty-sixth Day of December, 1989

*Attest:*

JEFFREY M. SAMUELS

*Attesting Officer* *Acting Commissioner of Patents and Trademarks*